United States Patent [19]

Denton

[11] Patent Number: 4,541,355

[45] Date of Patent: Sep. 17, 1985

[54] SAIL RIGGING

[76] Inventor: James B. Denton, 4009 Whispering La., Annandale, Va. 22003

[21] Appl. No.: 686,533

[22] Filed: Dec. 26, 1984

Related U.S. Application Data

[63] Continuation-in-part of Ser. No. 457,947, Jan. 14, 1983, abandoned.

[51] Int. Cl.[4] ..... B63H 9/06

[52] U.S. Cl. ..... 114/39; 114/98; 114/102; 114/103

[58] Field of Search ..... 114/39, 39.2, 102, 103, 114/98, 90, 91; 244/DIG. 1.1, 153 R

[56] References Cited

U.S. PATENT DOCUMENTS

| | | | |
|---|---|---|---|
| 481,614 | 8/1892 | Comstock | 114/98 X |
| 1,670,936 | 5/1928 | McIntyre et al. | 114/102 |
| 1,840,689 | 1/1932 | Baker | 135/109 X |
| 2,336,927 | 12/1943 | Cross | 114/98 |
| 3,487,800 | 1/1970 | Schweitzer et al. | 114/39 |
| 3,929,085 | 12/1975 | Mason | 114/123 |
| 4,068,607 | 1/1978 | Harmon | 114/102 |
| 4,382,417 | 5/1983 | Talve | 114/39.2 |

FOREIGN PATENT DOCUMENTS

| | | | |
|---|---|---|---|
| 0015875 | 9/1980 | European Pat. Off. | 114/39 |
| 0020121 | 12/1980 | European Pat. Off. . | |
| 1119702 | 12/1961 | Fed. Rep. of Germany . | |
| 64374 | 8/1938 | Norway | 114/102 |

*Primary Examiner*—Sherman D. Basinger
*Attorney, Agent, or Firm*—Peter L. Klempay

[57] ABSTRACT

The sailing device has a hull, a framed sail, a boom which is connected at its upper end to the sail by a universal connection located at the center of gravity of the sail, a vertical mast, an auxiliary boom pivotally connected at its lower end to the mast and at its upper end to a bar which is adjustably connected to the mast to vary the angle of the auxiliary boom, the auxiliary boom and the bar being rotatable as a unit about the axis of the mast and the boom being detachably connected to the auxiliary boom in parallel relation thereto. Preferably, the sail framing is collapsible for handling and storage.

11 Claims, 9 Drawing Figures

SAIL RIGGING

CROSS-REFERENCE TO RELATED APPLICATIONS

This application is a continuation-in-part of my earlier application Ser. No. 06/457,947, filed on Jan. 14, 1983 and now abandoned.

The present invention pertains to sailboats and, more particularly, to an improved sail rigging.

BACKGROUND OF THE INVENTION

All known sail riggings present a problem of roll stability, the wind generated forces on the sail generating a capsizing moment as well as the propulsion force. In order to provide stability, ballast may be provided, or on outrigger may be employed. While these arrangements serve to increase the roll stability, they have the detrimental effect of increasing drag and, accordingly, limiting the speed of the vessel. Among the prior art solutions to the problem of roll stability are the sail riggings shown in U.S. Pat. No. 4,068,607, Harmon: German Pat. No. 1,119,702, Pohl; and European Patent Application No. 0 020 121, Williams.

It is the primary object of the present invention to provide a sail rigging which substantially eliminates the capsizing moment without imposing undesirable drag.

It is a further object of the invention to provide a sail rigging which is easily controlled by the operator.

Another object of the invention is the provision of a sail rigging which permits control of the direction of motion of the vessel without the need for a rudder.

SUMMARY OF THE INVENTION

The above and other objects of the invention which will become apparent hereinafter are achieved by the provision of a sail rigging on a vessel having a hull and a dagger board; the rigging including a short vertical mast mounted immediately forward of the dagger board; a metal tube concentric with and rotatable about the mast, the tube including a tangentially projecting fin; an auxiliary boom pivotally connected at its lower end to the lower end of the fin; a boom detachably connected to the auxiliary boom; a control bar pivotally connected, at one of its ends, to the upper end of the auxiliary boom and, intermediate the ends, to the upper end of the fin; and a sail structure carried at the free end of the boom and connected thereto by a universal joint located at the center of gravity of the sail.

For a more complete understanding of the invention and the objects and advantages thereof, reference should be had to the following detailed description and the accompanying drawings wherein a preferred embodiment of the invention is described and illustrated.

DESCRIPTION OF THE PREFERRED EMBODIMENT

Figure 1:
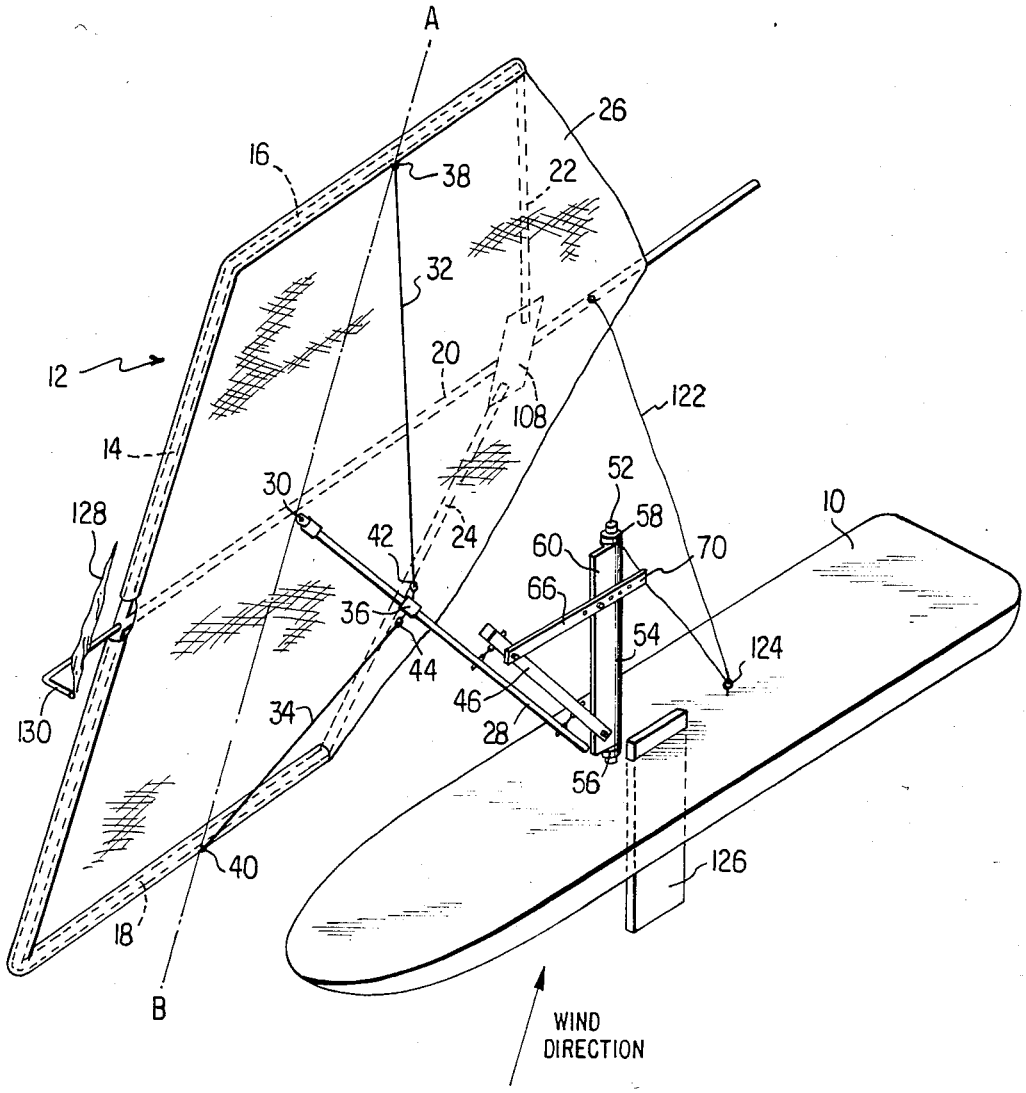
FIG. 1 is a perspective view of a vessel having the sail rigging of the present invention.

Referring first to FIG. 1, a hull is designated generally by the reference numeral 10 and may be of any suitable configuration. The hull may, for example, be a surfboard. The sail of the present invention is designated generally by the reference numeral 12 and includes a frame comprised of an upper or leading edge cross piece 14, end pieces 16 and 18, a central member 20 located midway between and parallel to the side pieces, and rear cross pieces 22 and 24, all preferrably formed of lightweight metal tubing. The sail is covered with a suitable fabric 26.

The sail is carried by a boom 28 connected to the central member 20 of the sail frame by a connection 30 located at the center of gravity of the sail and allowing full pivotal movement of the sail relative to the boom. Lines 32 and 34 are attached at 36 to the boom 28, the attachment permitting rotation about the boom, and at 38 and 40 to frame members 16 and 18, respectively, to maintain the line AB, which is parallel to the leading edge of the sail, perpendicular to the boom. Preferrably, each line 32 and 34 is a stainless steel wire and is connected to the attachment member 36 by means of snap hooks 42, 44, respectively. The lower end of the boom 28 is connected to an auxiliary boom 46 by means of spaced sets of eyebolts 48 and snap hooks 50. A short vertical mast 52 is carried by the hull 10 and, in turn, carries a tubular member 54 which is free to rotate about the mast 52, the tubular member 54 being retained by lower and upper collars 56 and 58, respectively. The member 54 includes a tangentially outwardly projecting fin 60 and is, preferrably, formed by extrusion. At the lower end of the fin 60, a bolt and wingnut 62 serve to pivotally connect the lower end of the auxiliary boom 46. A bar 66 is pivotally connected, preferrably with a bolt and wingnut, at one end to the upper end of the auxiliary boom 46 and, intermediate the ends thereof, to the upper end of the fin 60, again preferrably with a bolt and wingnut 64. The bar 66 is provided with a series of spaced holes 68 to permit variation in the angle of elevation of the auxiliary boom 46 and the main boom 28 connected thereto. The end portion 70 of the bar 66 projecting beyond the mast 52 functions as a control lever for determining the angle of the boom relative to the longitudinal axis of the hull, that is, the azimuth angle of the boom.

Figures 2, 3, 4:
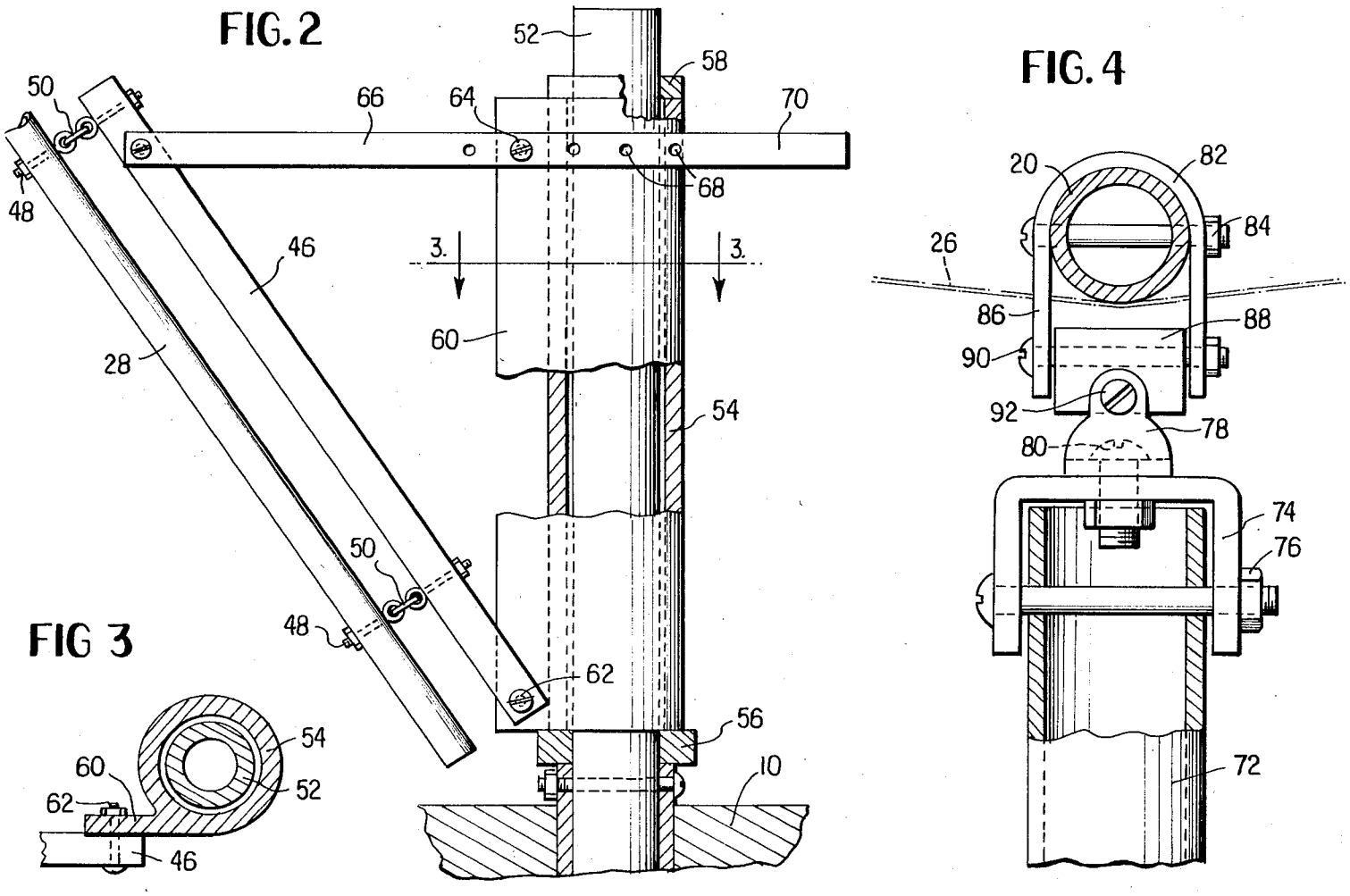
FIG. 2 is a fragmentary elevational view, partially in section, showing the connections between the boom and the mast.
FIG. 3 is a cross-sectional view taken on the line 3—3 of FIG. 2.
FIG. 4 is a fragmentary elevational view, partially in section, showing the connection between the boom and the sail frame.

Referring now to FIG. 4, the articulated connection 30 between the upper end 72 of the boom and the sail framing member 20 is illustrated. A bracket 74 is secured to the upper end 72 of the boom by a bolt 76. A U-shaped bracket 78 is attached to the bracket 74 by a second bolt 80, the connection permitting rotation of the U-shaped bracket about the axis of the bolt 80. A second U-shaped bracket 82 surrounds the sail frame member 20, is connected thereto by a bolt and nut 84, and includes downwardly extending end portions 86. A block 88, preferrably of nylon, is positioned between the upwardly projecting portions of the first U-shaped bracket 78 and the downwardly projecting ends 86 of the second U-shaped bracket 82. Non-intersecting bores extend through the block and receive bolts 90 and 92 to pivotally connect the block to the two U-shaped brackets, the connection permitting relative movement of the boom and the sail.

Figure 5:
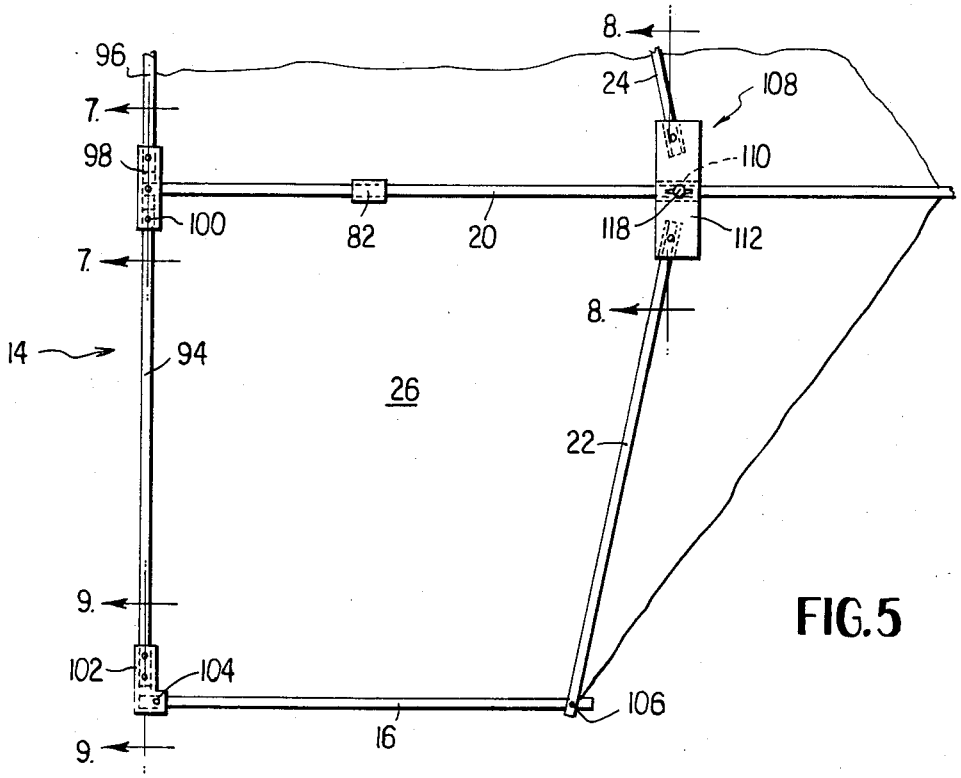
FIG. 5 is a fragmentary plan view of the sail framing in its in use configuration.
Figure 7:
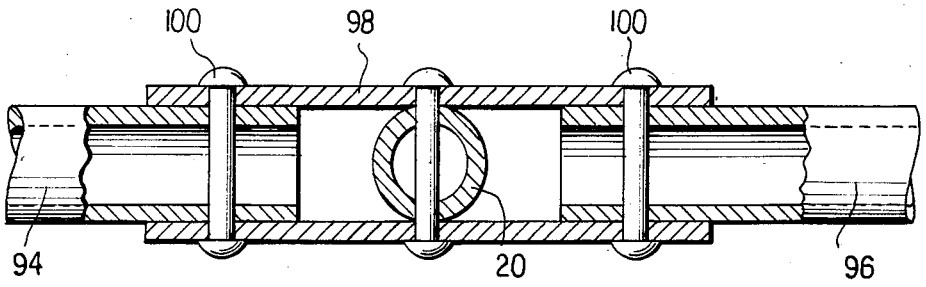
FIGS. 7, 8 and 9 are fragmentary cross-sectional views taken on the lines 7—7, 8—8 and 9—9, respectively, of FIG. 5 and showing the details of the sail framing.
Figure 8:
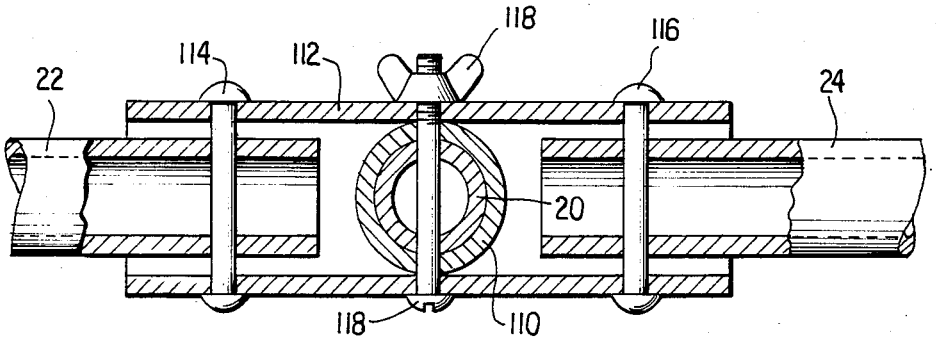
Figure 9:
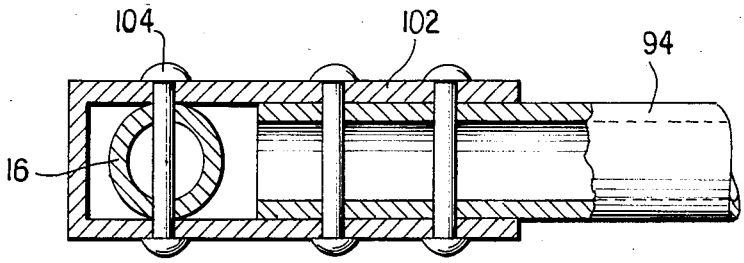

As has been discussed in the preceeding descriptions of the connections between the boom and the auxiliary boom and between the boom and the sail framing, each connection includes removable fasteners, thus permitting the boom to be disconnected from the hull and from the sail. Also, the mast is removable from the hull. In addition, the sail framing is preferrably constructed so as to be readily collapsible. Thus, as is shown in FIGS. 5 and 7, the leading edge cross piece 14 may be formed of two tubing lengths 94 and 96 joined by a connector assembly 98 which is also attached to the central framing member 20. The connections of the ends of the tubing lengths 94 and 96 to the assembly 98 are by means of bolts, pins, or other fasteners 100 which allow the tubing lengths to be pivoted thereabout in order to facilitate the collapsing of the sail framing as will be described hereinafter. Mounted at the outer end of the tubing length 94 is a second connector assembly 102 to which is connected the forward end of the side piece 16, again by means of a bolt 104 or the like allowing pivotal movement. Although not shown in FIG. 5, the second side piece 18 is similarly connected to the end of the tubing length 96. The rear cross piece 22 is pivotally connected at its outer end to the rear end of the side piece 16 by a bolt 106 or other fastener. Likewise, the rear cross piece 24 is pivotally connected to the side piece 18. The inner ends of the rear cross pieces 22 and 24 are pivotally joined to a movable connector assembly 108, illustrated in greater detail in FIG. 8. The connector assembly 108 includes an open ended tubing length 110 which is telescopingly received over the central framing member 20 and a pair of plates 112 secured to the tubing length 110 and projecting laterally therefrom. Suitable pins 114 and 116, or other fasteners, serve to pivotally connect the rear cross pieces 22 and 24, respectively, to the plates 112 and a removable fastener, such as the bolt and wingnut 118, releasably secures the connector assembly 108 in position on the framing member 20. The leading and side edges of the sail fabric 26 are folded over the corresponding framing members 94, 96, 16 and 18 and sewn to secure the sail fabric to these members. The rear end of the sail fabric is releasably secured to the central framing member 20 aft of the connector assembly by any suitable means.

Figure 6:
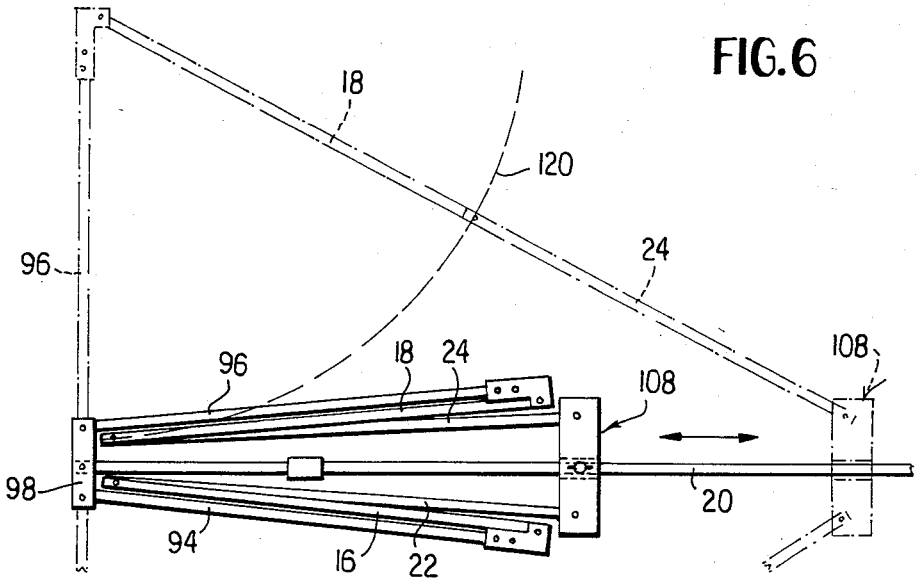
FIG. 6 is a fragmentary plan view of the sail framing structure as collapsed for transportation and storage.

As was mentioned above, the sail frame is designed to be collapsed into a compact assemblage for handling and storage. The manner in which the sail frame is collapsed is shown in FIG. 6. With the sail fabric disconnected from the contral framing member 20 and the fastener 118 withdrawn from the connector assembly 108, the assembly 108 is moved rearwardly on the framing member 20 to the position shown in phantom outline and in which the side frame pieces 16, 18 and the corresponding rear frame pieces 22, 24 respectively, are colinear. Subsequently, the connector assembly 108 is moved forwardly on the framing member 20 and the leading edge, side and rear framing members folded together into generally parallel relation to the central framing member, the pivotal connection between the side and rear framing members moving in the arcuate path designated by the numeral 120.

In use, the boom 28 is brought to an angle of elevation from the horizontal by means of the control bar 66. The angle of elevation is preferrable 45° but may range between about 30° and about 80°. The control bar is secured by means of a bolt and wingnut, for example, to maintain the selected angle of elevation. The forces developed by the sail are transmitted to the hull soley by the boom 28 and control line 122 and act at the base of the mast and the fairlead pulley 124 which are located in the plane of the dagger board 126 and fore and aft thereof, respectively. When the line of force passes through the center of the dagger board, forward motion of the craft results. If the line of force is shifted forwardly of the center of the dagger board, the craft will turn in the direction of the sail. This shifting is accomplished by altering the angle in azimuth of the boom 28, the end portion 70 of the control bar 66 providing a convenient means for turning the boom. The control line 122 serves to control the thrust of the sail structure. A wind indicator in the form of a cloth strip 128 carried by a forwardly extending support 130 of the sail frame is provided to aid in manuevering the craft.

While a preferred embodiment of the invention has been illustrated and described, it will be understood that changes and additions may be made therein and thereto without departing from the spirit of the invention. Reference should, accordingly, be had to the appended claims in determining the true scope of the invention.

I claim:

1. Sailing apparatus comprising:

a hull;

a vertical mast connected to and extending upwardly from said hull;

a tubular member concentric with and rotatable about the axis of said mast;

a boom;

an auxiliary boom connected at its lower end to said tubular member for pivotal movement about a horizontal axis;

first connecting means joining said boom and said auxiliary boom in parallel relation;

a sail assembly including a frame and a fabric cover;

second connecting means joining the upper end of said boom to said sail assembly and permitting pivotal movement of said sail assembly relative to said boom; and means connected to said mast and said auxiliary boom for controllably positioning said auxiliary boom, said boom carried thereby and said said assembly, said lastmentioned means including a control bar attached to said auxiliary boom adjacent the upper end thereof, extending generally horizontally past said mast when in its operative position, and adjustably connected to said mast.

2. The sailing apparatus of claim 1 wherein said second connecting means is located at the center of gravity of said sail assembly.

3. Sailing apparatus comprising:

a hull;

a vertical mast connected to and extending upwardly from said hull;

a tubular member concentric with and rotatable about the axis of said mast;

a boom;

an auxiliary boom connected at its lower end to said tubular member for pivotal movement about a horizontal axis;

first connecting means joining said boom and said auxiliary boom in parallel relation;

a sail assembly including a frame and a fabric cover, said sail assembly frame including a first framing member extending along the leading edge of said sail assembly, a pair of second framing members connected, respectively, at the first ends thereof to opposite ends of said first framing member and extending along opposite sides of said sail assembly, a third framing member connected to said first framing member at the midpoint thereof and extending parallel to said pair of second framing members, and fourth framing members connected between the second ends of said second framing members and said third framing member;

second connecting means located at the center of gravity of said sail assembly joining the upper end of said boom to said sail assembly and permitting pivotal movement of said sail assembly relative to said boom; and means connected to said mast and said auxiliary boom for controllably positioning said auxiliary boom, said boom carried thereby and said sail assembly.

4. The sailing apparatus of claim 3 wherein said framing members are interconnected by releasable connector means whereby said sail assembly may be collapsed.

5. The sailing apparatus of claim 1 wherein said hull is a surfboard type hull.

6. Sailing apparatus comprising:

a hull;

a vertical mast connected to and extending upwardly from said hull;

a tubular member concentric with and rotatable about the axis of said mast;

a boom;

an auxiliary boom connected at its lower end to said tubular member for pivotal movement about a horizontal axis;

first connecting means joining said boom and said auxiliary boom in parallel relation;

a sail frame having a leading edge framing member, a pair of side edge framing members connected, respectively, to opposite ends of said leading edge framing member, a central framing member connected to the midpoint of said leading edge framing member and extending parallel to said side edge framing members, and rear framing members connected between said side edge framing members and said central framing member;

a sail fabric carried by said sail frame;

second articulated connecting means attaching the upper end of said boom to said central framing member at the center of gravity of said sail frame and sail fabric assembly;

first control means for controlling the position of said boom; and second control means for controlling the position of said sail assembly.

7. The sailing apparatus of claim 6 wherein said sail frame is collapsible.

8. The sailing apparatus of claim 7 wherein said mast is removably connected to said hull.

9. The sailing apparatus of claim 6 wherein said first control means includes a control bar attached to said auxiliary boom adjacent the upper end thereof, extending generally horizontally past said mast when in its operative position, and adjustably connected to said mast.

10. The sailing apparatus of claim 6 wherein said second control means includes a fair lead mounted on said hull rearwardly of said mast and a line attached at one end to said sail frame, extending through said fair lead, and securable at its opposite end to said mast.

11. A sail frame adapted for use with a sailing craft of the type having a hull, a mast, and a boom connected at one of its ends to said mast and at the other of its ends to the sail frame comprising:

a pair of first framing members extending along the leading edge of the sail;

a pair of side framing members, one end of each side framing members being pivotally connected to one end of one of said first framing members, the side framing members extending perpendicular to the first framing members in the operative position of said sail frame;

a central tubular framing member pivotally connected to the other end of each of said first framing members, said central framing member being located midway between and parallel to said side framing members in the operative position of said sail frame;

a pair of rear framing members, one end of each rear framing member being pivotally connected to the other end of one of said side framing members; and a connector assembly slidably carried on said central framing member and pivotally connected to the other ends of said rear framing members.

* * * * *